US010946252B1

(12) United States Patent
Conboy

(10) Patent No.: US 10,946,252 B1
(45) Date of Patent: Mar. 16, 2021

(54) BALL PICKUP AND STORAGE DEVICE

(71) Applicant: John S. Conboy, Chesterfield, MO (US)

(72) Inventor: John S. Conboy, Chesterfield, MO (US)

(73) Assignee: John S. Conboy, Chesterfield, MO (US)

( * ) Notice: Subject to any disclaimer, the term of this patent is extended or adjusted under 35 U.S.C. 154(b) by 0 days.

(21) Appl. No.: 16/653,107

(22) Filed: Oct. 15, 2019

(51) Int. Cl.
*A63B 47/02* (2006.01)
*A63B 102/02* (2015.01)

(52) U.S. Cl.
CPC ..... *A63B 47/02* (2013.01); *A63B 2102/02* (2015.10)

(58) Field of Classification Search
CPC ..... A63B 47/02
USPC ..... 473/460; D21/721
See application file for complete search history.

(56) References Cited

U.S. PATENT DOCUMENTS

| | | | | |
|---|---|---|---|---|
| 3,820,836 | A | 6/1974 | Seewagen et al. | |
| D244,149 | S | 4/1977 | Davis | |
| D250,361 | S | 11/1978 | James | |
| 4,412,697 | A | 11/1983 | Verde | |
| 4,461,504 | A | 7/1984 | Perez et al. | |
| 4,811,980 | A | 3/1989 | Ferrari et al. | |
| 5,294,161 | A | 3/1994 | Stap | |
| 5,368,351 | A * | 11/1994 | Cuti | A63B 47/02 248/132 |
| 5,464,262 | A | 11/1995 | Madrazo | |
| D366,143 | S | 1/1996 | Guzman | |
| D380,026 | S | 6/1997 | Frankel | |
| D422,028 | S | 3/2000 | Warner | |
| 6,142,544 | A | 11/2000 | Benzoni et al. | |
| D445,469 | S | 7/2001 | Loerop et al. | |
| 6,302,460 | B1 | 10/2001 | Carr | |
| 6,340,188 | B1 * | 1/2002 | Cuti | A63B 47/02 294/19.2 |
| D454,607 | S | 3/2002 | Cuti | |
| D461,859 | S | 8/2002 | Dirks | |
| 6,845,578 | B1 | 1/2005 | Lucas | |
| D517,139 | S | 3/2006 | Kim | |

(Continued)

FOREIGN PATENT DOCUMENTS

DE 102007023741 A1 * 11/2008 ..... A63B 47/02

OTHER PUBLICATIONS

English machine translation of DE 10 2007 023 741 A1 (Year: 2008).*

*Primary Examiner* — Laura Davison
(74) *Attorney, Agent, or Firm* — Quinn IP Law

(57) ABSTRACT

A device for picking up balls from a court surface comprises: a container having a bottom face which includes a bottom outer frame and a plurality of elongate members forming a door; a plurality of elongate legs having top and bottom ends, wherein each bottom end is integral with the container; and a support frame formed by the top ends and at least one transverse member. The device may be inverted between a first position, in which the device is supported on the court surface by the bottom face, and a second position, in which the device is supported by the support frame, without movement of any parts of the device with respect to each other. In the first position, the bottom face may be pressed against balls on the court surface so as to urge them through openings between the elongate members and into the interior of the container.

19 Claims, 7 Drawing Sheets

(56) References Cited

U.S. PATENT DOCUMENTS

| | | | | |
|---|---|---|---|---|
| D540,409 | S | 4/2007 | Martin et al. | |
| 7,377,565 | B1 | 5/2008 | Beavin | |
| 8,141,919 | B2 | 3/2012 | Turdo | |
| 8,177,271 | B2 | 5/2012 | Zats | |
| 8,328,254 | B1 | 12/2012 | Zats | |
| 9,839,816 | B2 | 12/2017 | Qiu et al. | |
| 2007/0191145 | A1 | 8/2007 | Winter | |
| 2008/0122233 | A1 | 5/2008 | Beavin | |
| 2010/0323827 | A1 | 12/2010 | Misiak et al. | |
| 2011/0204664 | A1 | 8/2011 | Turdo | |
| 2016/0256751 | A1* | 9/2016 | Barandao | A63B 47/02 |

* cited by examiner

BALL PICKUP AND STORAGE DEVICE

INTRODUCTION

This disclosure relates to ball pickup and storage devices, such as may be used to pick up tennis balls, pickle balls and the like from court surfaces.

Tennis and pickle ball are typically played on courts having relatively hard surfaces made of asphalt, concrete, clay or grass turf. When players are engaged in a game, or when one or more players are practicing their serves and returns, it is common for several balls to be scattered around the court. When the players desire to pick up the scattered balls, they may do so by hand, or they may use a ball pickup device.

Conventional ball pickup devices typically consist of a generally rectangular wire basket with movable extensions that can be folded up into a first arrangement and used as handles to maneuver and carry the device, and folded down into a second arrangement to serve as legs to support the device. The bottom of the wire basket is typically constructed of wires, rods or elastic members that are spaced apart from one another by a distance slightly smaller than the diameter of the balls with which the device is intended to be used. The device can be used to pick up balls from a court surface by folding the movable extensions up into the first arrangement, gripping the extensions as handles, maneuvering the device so that it is placed over one or more balls, and pressing down on the extensions so that the bottom of the basket is pressed down onto the ball(s). In doing so, the bottom wires, rods or elastic members flex slightly and temporarily, thereby allowing the compressed ball(s) to pass through the bottom and enter the interior of the basket where they are retained.

The side walls of the basket may be made of wires or rods similar to the bottom of the basket, and together the side walls and bottom serve to keep any balls placed into the basket from falling out when the basket/device is in an upright orientation. Some devices also include a top door (e.g., made of wires or rods similar to the bottom and side walls) hinged onto one top edge of a side wall, with the top door having latches so that it may be latched shut. This allows the device to be transported while keeping any balls inside the basket from falling out, even when the basket/device is in a non-upright orientation. With balls retained inside the basket, the extensions may be folded down into the second arrangement to serve as legs, the extensions/legs placed on the court surface with the basket propped up atop the extensions/legs off of the court surface, and the top may be unlatched so that balls may be removed for serving, teaching, etc.

One drawback of conventional ball pickup devices is that the movable extensions have to be folded up and down continuously when switching back and forth between the two arrangements. Another drawback is that in order to add balls by hand into the basket when the device is in the second arrangement, the top door must be unlatched and opened before balls can be added. And yet another drawback is that in order to add balls by hand into the basket when the device is in the first arrangement, either the top door must be unlatched and opened before balls can be added, or the extensions may prevent the top door from being opened at all, therefore preventing balls from being added by hand in this first arrangement.

It would be desirable, therefore, to provide a ball pickup device which does not suffer from these and other drawbacks.

SUMMARY

According to one embodiment, a device for picking up at least one ball from a court surface includes a container having a top face, a bottom face and at least one side wall between the top face and the bottom face. The bottom face includes a bottom outer frame and a plurality of elongate members. The elongate members are oriented along a first direction and cooperate to form a door having a first end rotatably connected to a first side of the bottom outer frame and a second end engageably and disengageably connectable to a second side of the bottom outer frame. The elongate members are disposed so as to provide an opening between each pair of adjacent elongate members and between the bottom outer frame and each elongate member adjacent thereto, each opening having a first width less than a diameter of the at least one ball and through which a compressed one of the at least one ball may be forced. The device further includes a plurality of elongate legs each having respective top and bottom ends, wherein each bottom end is integral with the container. A support frame is formed by the top ends and at least one transverse member, each of the at least one transverse member being connected to at least two of the elongate legs proximate their respective top ends. The device is configured to be disposed in a first position with the device supported on the court surface by the bottom face and in a second position with the device supported on the court surface by the support frame. The device is also configured to be inverted between the first and second positions without movement of any parts of the device with respect to each other.

Each of the top face and the bottom face may be generally rectangular and the at least one side wall may comprise four side walls. The door may include at least one cross-member connecting the elongate members together at at least one of the first end and the second end, and at least one latch disposed at the second end, wherein each of the at least one latch is configured to engageably and disengageably connect to the second side of the bottom outer frame. The support frame may serve as a handle for grasping the device in the first position.

The top face may include a top outer frame and at least one elongate component. Each of the at least one elongate component may have a respective third end connected to a third side of the top outer frame, and a respective fourth end connected to a fourth side of the top outer frame. The at least one elongate component may be arranged so as to provide a gap between each pair of adjacent elongate components, with each gap having a second width approximately equal to the first width.

In the first position, the at least one ball may be received into an interior of the container by pressing the bottom face against the at least one ball sitting atop the court surface so as to urge the at least one ball through one of the openings, or by manually forcing the at least one ball through one of the gaps. The bottom face, top face and support frame may have respective centers defining a central vertical axis, wherein each of the plurality of elongate legs may be curved toward the central vertical axis. The side wall assembly may include four contiguous side walls. The device may further include at least one roller on each of the bottom outer frame and the support frame. An outer perimeter of the support frame may be about the same size as an outer perimeter of the bottom outer frame. The bottom face, top face, support frame and elongate legs may be made of rods having the same diameter and made of the same material.

In another embodiment, a ball pickup device for picking up a ball from a court surface includes a bottom frame, a top frame and a side wall assembly defining a container. The bottom frame has a generally rectangular bottom frame outer portion and a plurality of elongate members. The bottom frame outer portion defines a bottom frame outer perimeter and includes a pair of opposed first side portions and a pair of opposed second side portions. The elongate members are oriented in a direction parallel to the first side portions and cooperate to form a door having a first end rotatably connected to a first side of the bottom frame outer portion and a second end engageably and disengageably connectable to a second side of the bottom frame outer portion, the elongate members being spaced apart so as to provide an opening between each pair of adjacent elongate members and between the bottom frame outer portion and each elongate member adjacent thereto, each opening having a first width less than a diameter of the ball and through which the ball may be forced.

The top frame is disposed generally parallel with the bottom frame and has a top frame outer portion defining a top frame outer perimeter smaller than the bottom frame outer perimeter. The top frame has at least one elongate component, each of the at least one elongate component having a respective third end connected to a third side of the top frame outer portion and a respective fourth end connected to a fourth side of the top frame outer portion. The at least one elongate component is arranged so as to provide a gap between each pair of adjacent elongate components, with each gap having a second width approximately equal to the first width.

The device includes a plurality of elongate legs, each having a respective top end, a respective bottom end and a respective middle point between the respective top and bottom ends. Each bottom end is attached to the bottom frame and each middle point is attached to the top frame. The device also includes a side wall assembly comprising four side walls, with each side wall being generally disposed between and attached to a respective pair of adjacent elongate legs and extending between the bottom frame and the top frame, wherein the bottom frame, top frame and the side wall assembly define a container therewithin. The device further includes a support frame formed by the top ends of the elongate legs and at least one transverse member. Each transverse member is connected to at least two of the elongate legs proximate their respective top ends.

The device is configured to be disposed in first and second positions with the device supported on the court surface by the bottom frame and the support frame, respectively. The device is also configured to be inverted between the first and second positions without movement of any parts of the device with respect to each other.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

Figure 3:
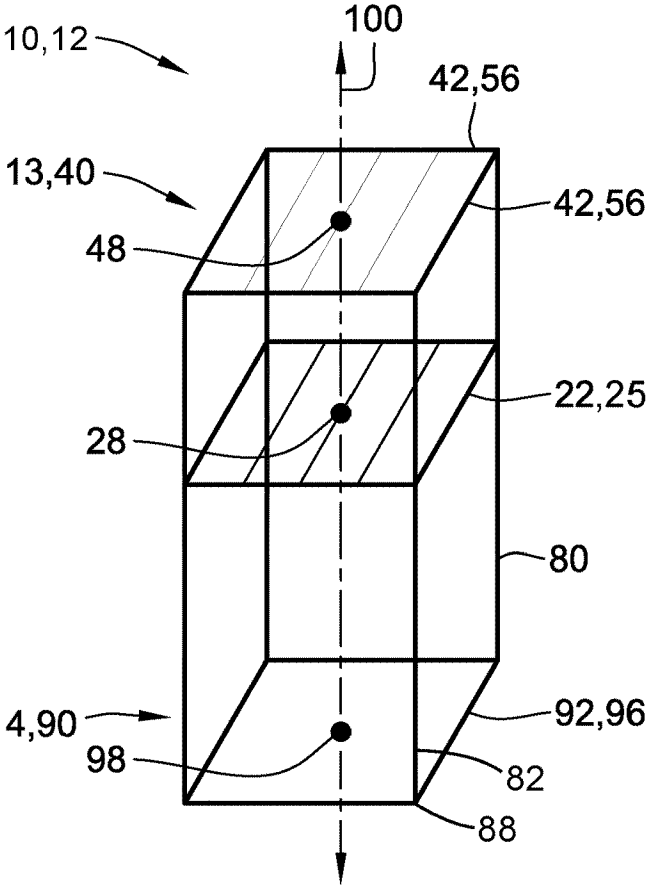
FIG. 3 is a schematic perspective view of the device shown in FIGS. 1-2, disposed in a second position (with the side walls removed) in accordance with the disclosure.
Figure 2:
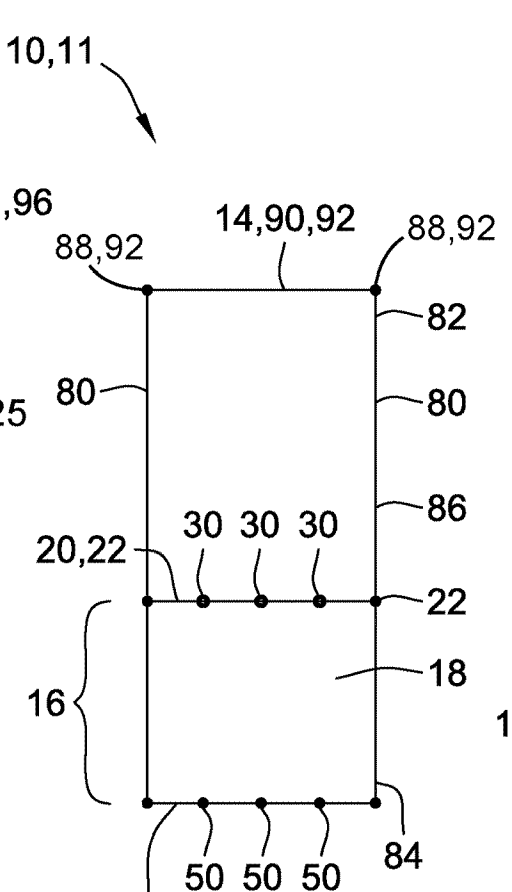
FIGS. 1-2 are schematic perspective and side views, respectively, of a first configuration of a device disposed in a first position (with the side walls removed) in accordance with the disclosure.
Figure 1:
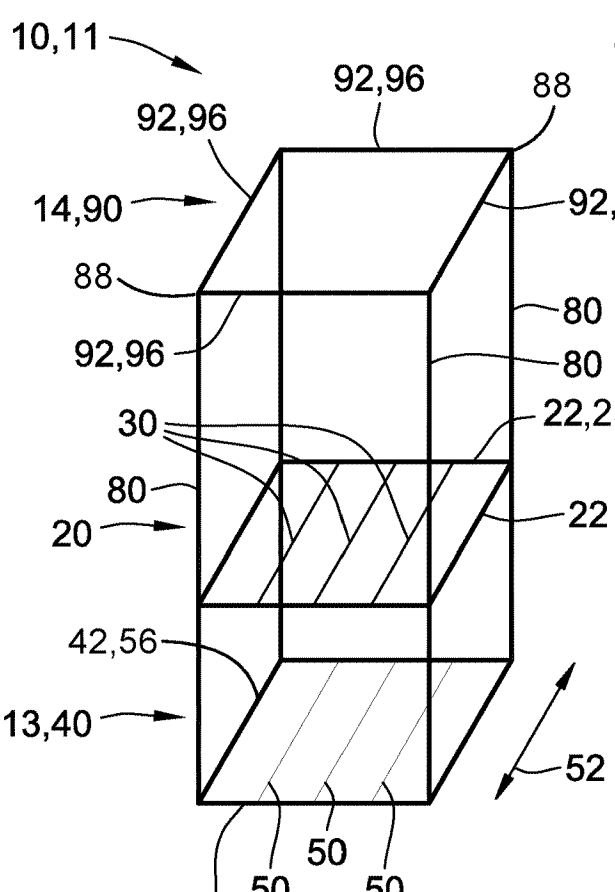
Figure 6:
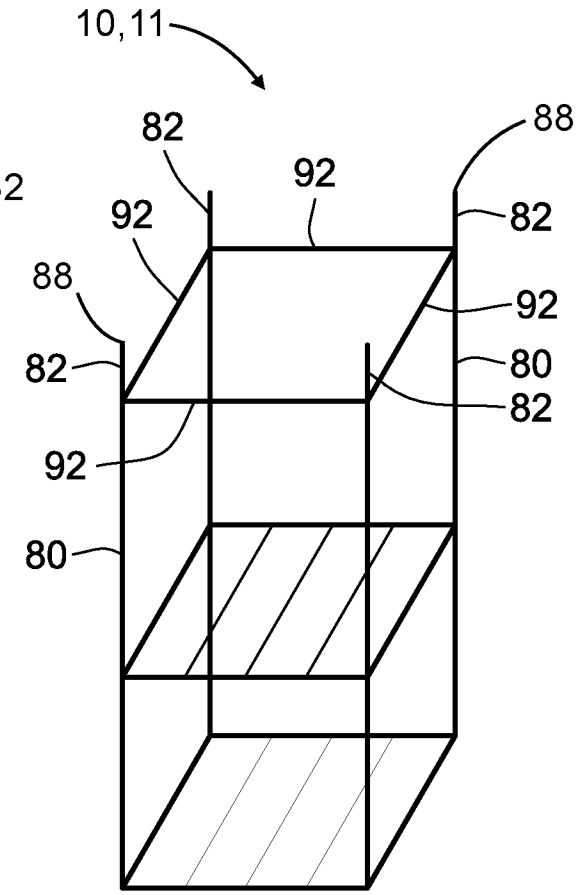
FIGS. 4-6 show second, third and fourth configurations, respectively, of a device disposed in a first position (with the side walls removed) in accordance with the disclosure.
Figure 5:
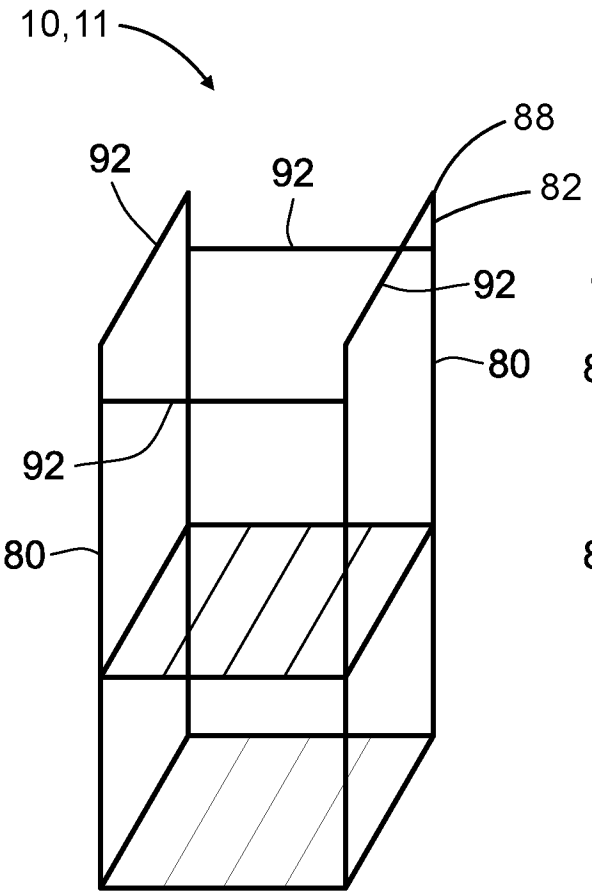
Figure 4:
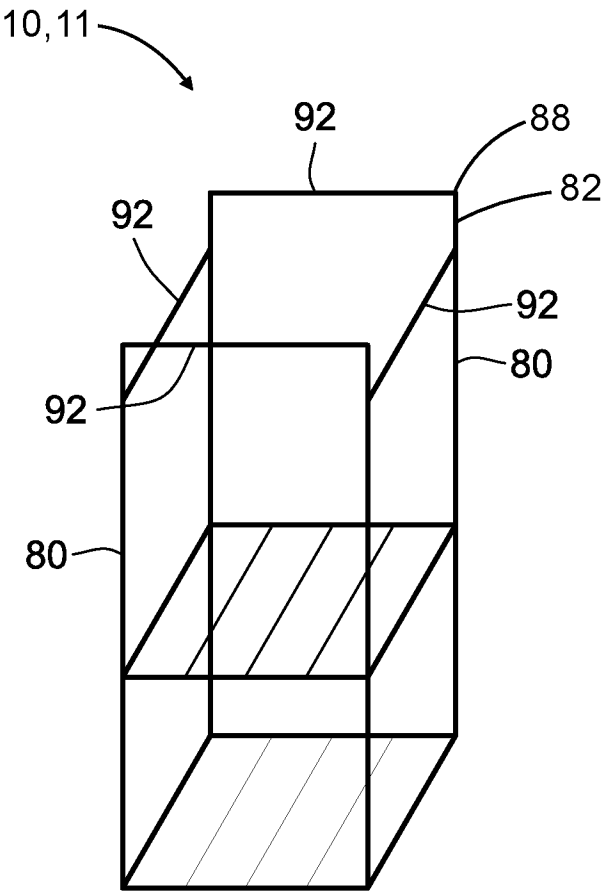

Referring now to the drawings, wherein like numerals indicate like parts in the several views, a ball pickup and storage device 10 for picking up at least one ball 1 from a court surface 9 is shown and described herein.

Figure 11:
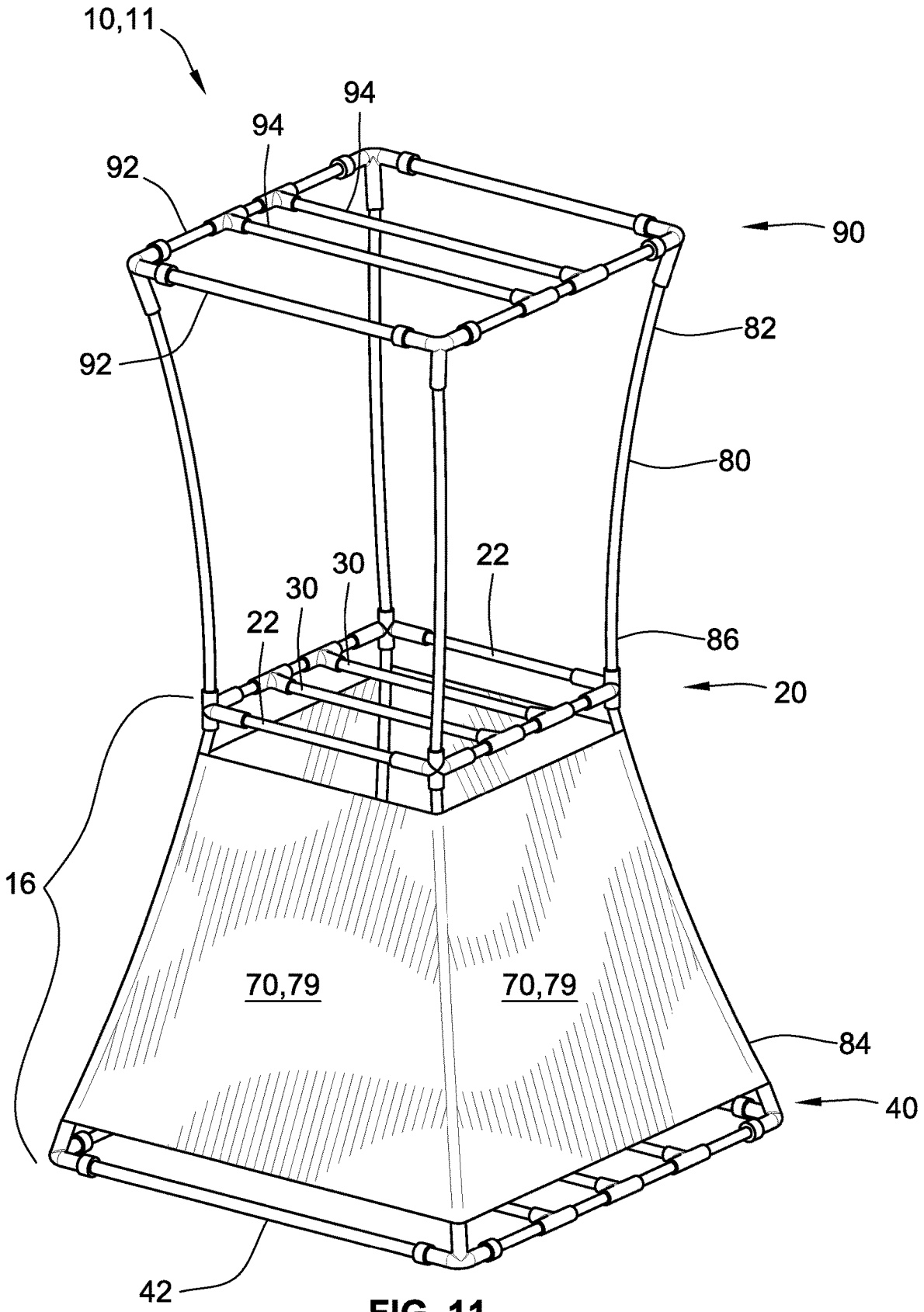
FIGS. 11-12 are perspective views of a sixth configuration of a device disposed in first and second positions, respectively, in accordance with the disclosure.
Figure 12:
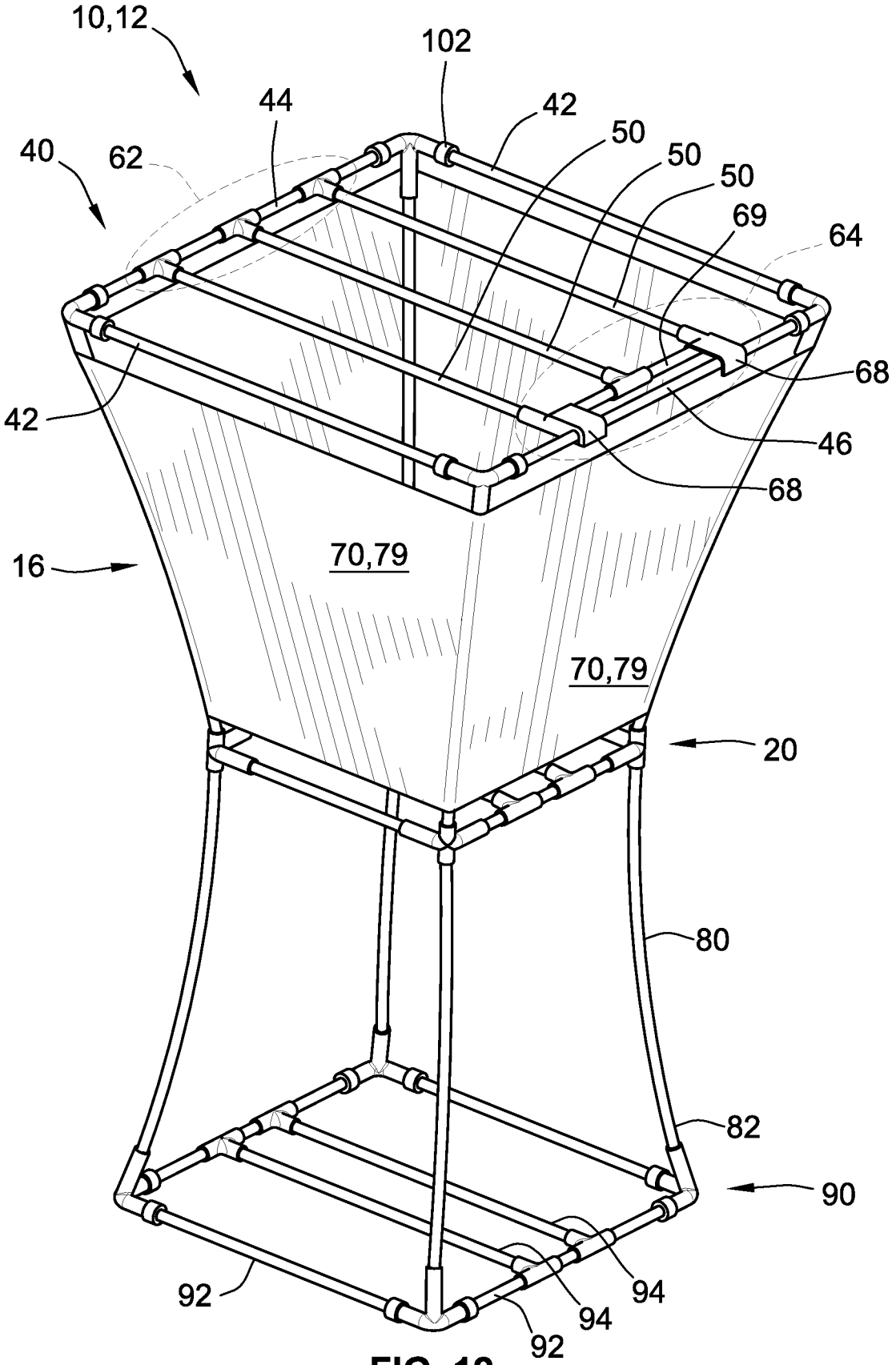

FIGS. 1-8 show five different but related configurations of the device 10 displayed schematically without side walls 70, 79 for the sake of illustration, and FIGS. 11-12 show a different but related sixth configuration of the device 10 shown in detail with side walls 70, 79. In each of these views (as well as in FIGS. 13-15), the device 10 is shown disposed in either a first position 11 (which may be thought of as a "pickup" or "maneuvering" position) or a second position 12 (which may be thought of as a "teaching" or "serving" position), and the device 10 may be inverted between these two positions 11, 12 without movement of any parts of the device 10 with respect to each other (i.e., without any moving parts).

Figure 14:
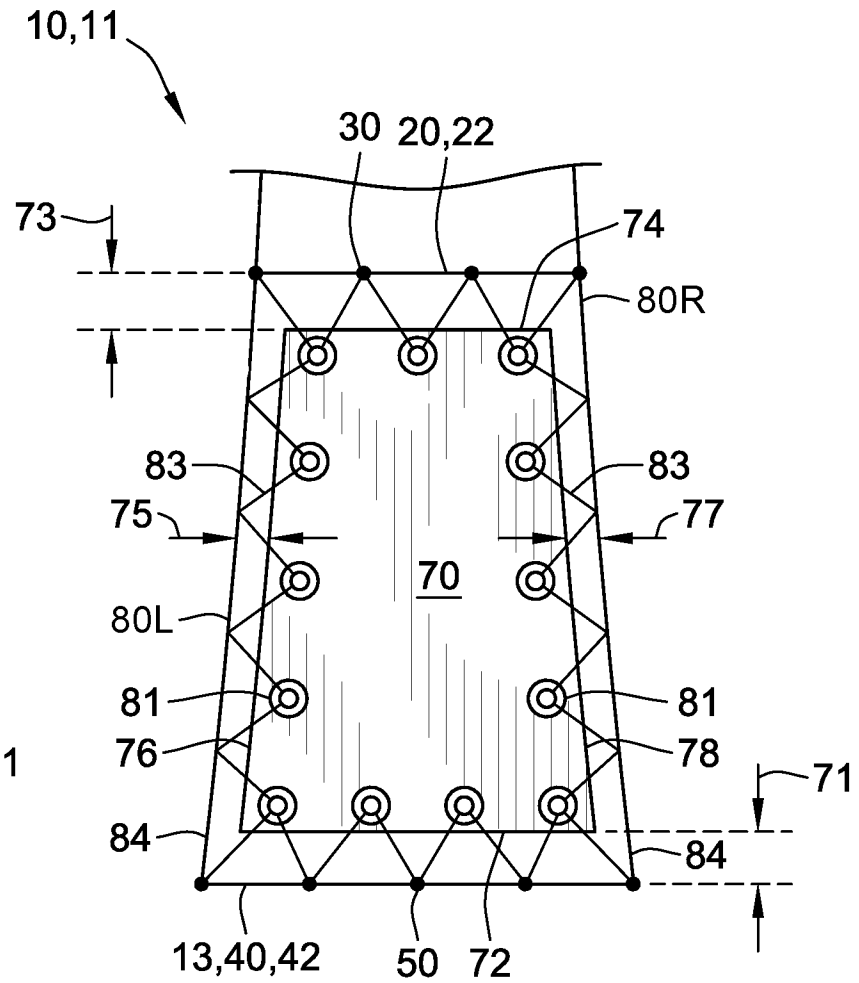
FIGS. 13-14 are schematic partial side views of a device in accordance with the disclosure.
Figure 15:
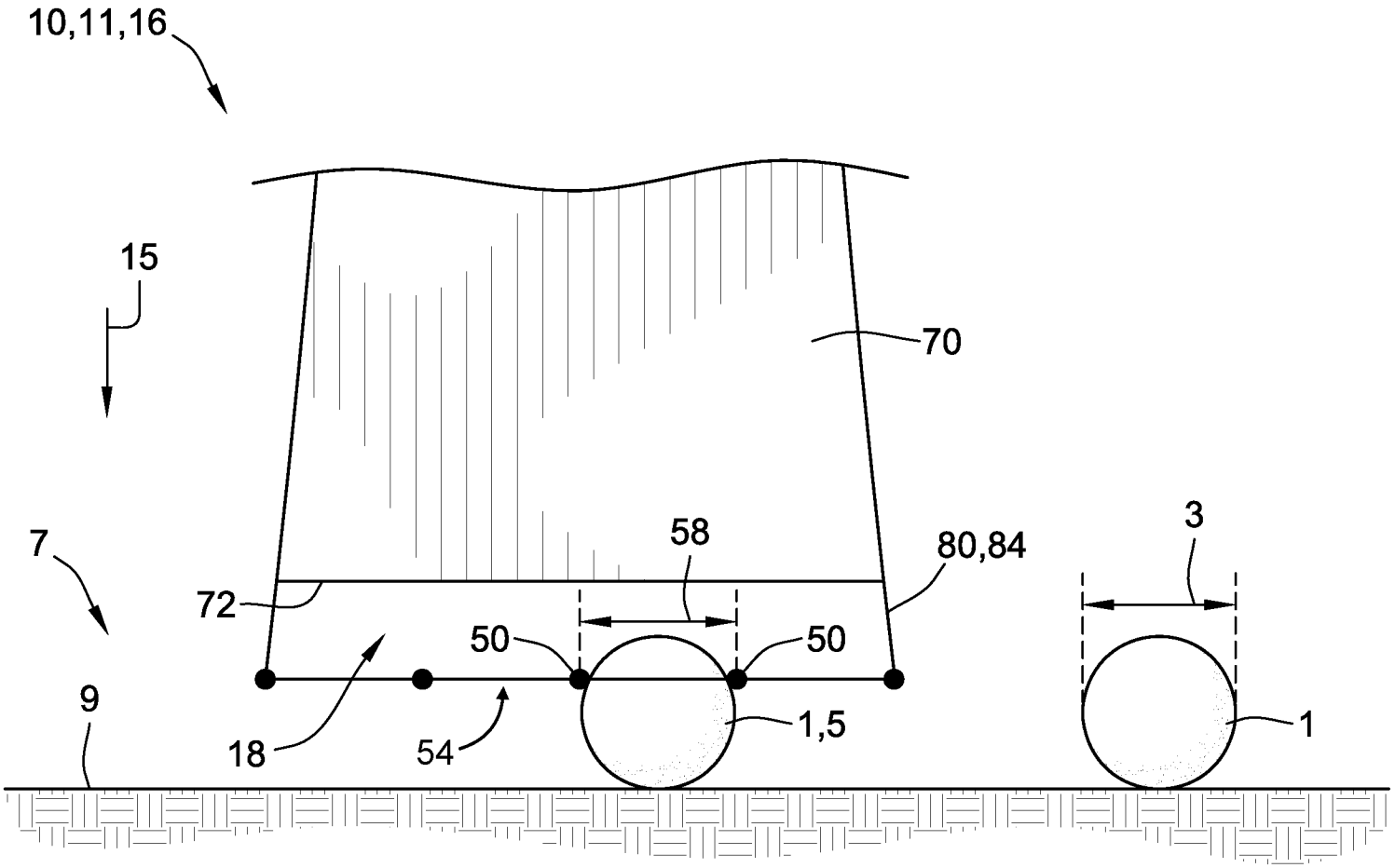
FIG. 15 is a schematic partial side view of a device being used to pick up balls from a court surface in accordance with the disclosure.

With the device 10 in the first/pickup/maneuvering position 11, as illustrated in FIGS. 1-2, 4-8, 11 and 13-15, a top end 14 of the device 10 will be facing "upward" (e.g., away from a court or floor surface 9) and a bottom end 13 of the device 10 will be facing "downward" (e.g., toward the court or floor surface 9, in the direction 15 indicated in FIG. 15). On the other hand, with the device 10 in the second/teaching/serving position 12, as illustrated in FIGS. 3 and 12, the bottom end 13 will be facing upward and the top end 14 will be facing downward.

The device 10 includes a container 16 having a top face 20, a bottom face 40 and at least one side wall 70 between the top face 20 and the bottom face 40. The bottom face 40 includes a bottom outer frame 42 around the perimeter 56 of the bottom face 40, and a plurality of elongate members 50 oriented along a first direction 52 (i.e., generally parallel with each other). The elongate members 50 are disposed so as to provide an opening 54 between each pair of adjacent elongate members 50, and also between the bottom outer frame 42 and each elongate member 50 adjacent thereto. Each opening 54 (through which a compressed ball 5 may be forced) has a first width 58 that is less than the diameter 3 of the ball 1, 5. Once balls 1 are forced into the interior 18 of the container 16 (either through the openings 54 in the bottom face 40, or through the gaps 36 in the top face 20 as described below), the balls 1 are retained within the container 16 by the top face 20, bottom face 40 and side wall(s)/side wall assembly 70, 79.

Figure 8:
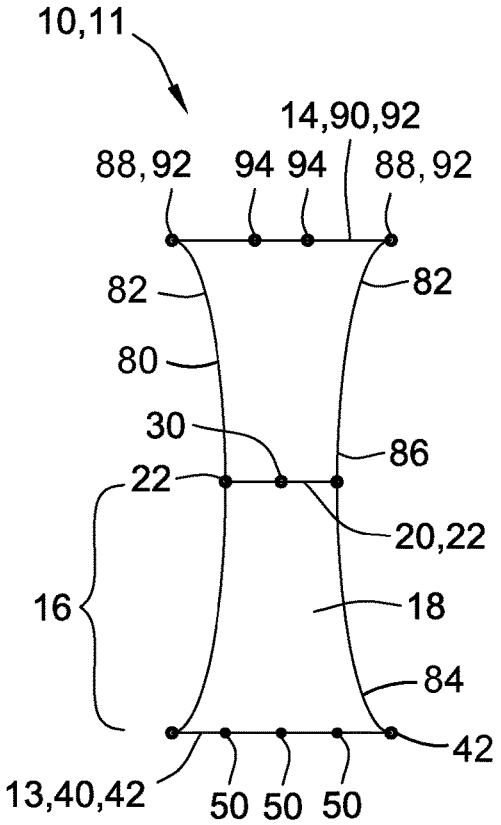
Figure 9:
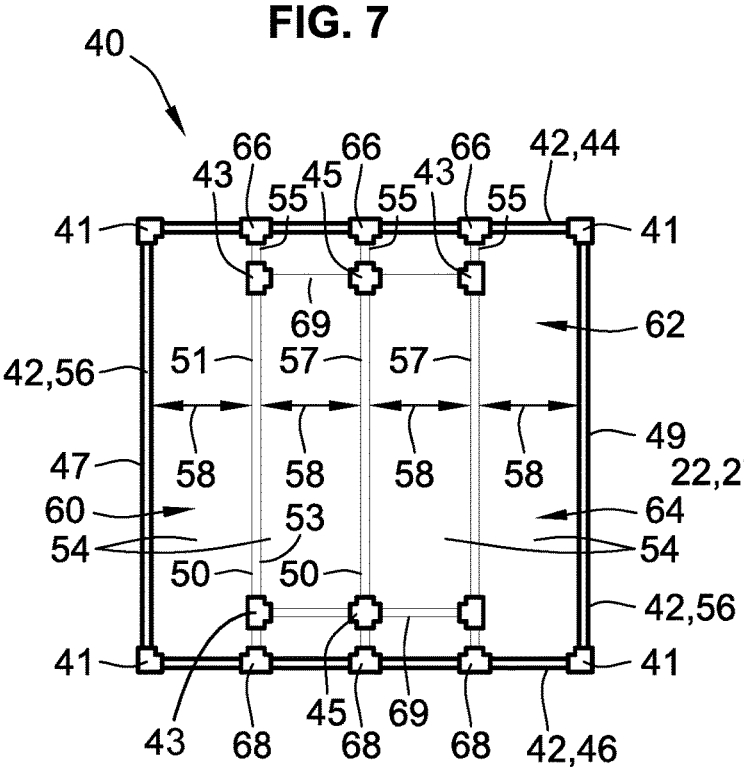
FIG. 9 is a bottom plan view of a bottom face of a device in accordance with the disclosure.

FIG. 9 shows a detailed plan view of one embodiment of the bottom face 40. In this view, the elongate members 50 cooperate to form a door 60 having a first end 62 rotatably connected to a first side 44 of the bottom outer frame 42 and a second end 64 engageably and disengageably connectable to a second side 46 of the bottom outer frame 42. (Note that for illustration purposes, the door 60 is not shown in the schematic drawings of FIGS. 1-8.) At least one elongate member 50 may serve as the door 60, while other elongate members 50 that are not part of the door 60 (if any) may be attached at their respective first and second ends 51, 53 to the first and second sides 44, 46 of the bottom outer frame 42. Thus, all of the elongate members 50 may cooperate to form the door 60, or some subset of all the elongate members 50 may cooperate to form the door 60. The door 60 may be rotatably connected to the first side 44 of the bottom outer frame 42 by swivels, hinges or other suitable connectors 66. For example, each of the doors 60 shown in FIGS. 9 and 12 has three T-shaped connectors 66 rotatably connected to the first side 44 of the bottom outer frame 42. The first side 44 shown in FIGS. 9 and 12 may be a single rod which extends through all three rotatable connectors 66, or the first side 44 may comprise four individual rod segments wherein each segment would extend only part-way through the connector (s) 66 with which the segment is rotatably engaged.

As illustrated in FIGS. 9 and 12, the door 60 may include at least one cross-member 69 connecting the elongate members 50 together at the first end 62 of the door 60, at the second end 64 of the door 60, or at both ends 62, 64. For example, FIG. 9 shows a cross-member 69 at both the first and second ends 62, 64, while FIG. 12 shows a cross-member 69 only at the second end 64. The door 60 may also include at least one latch 68 disposed at the second end 64, wherein each latch 68 is configured to engageably and disengageably connect to the second side 46 of the bottom outer frame 42 (such as by snap fit, detents, interference fit, clasps, etc.). The latch(es) 68 may be engaged to keep the door 60 closed during transport of the device 10 so that the balls 1 inside the container 16 do not spill out, and may be disengaged to allow the door 60 to be opened to permit access to the balls 1.

The bottom face 40 (including the bottom outer frame 42, the elongate members 50 and the door 60) may include a variety of connectors. These may include corner connectors 41 for connecting together the segments making up the bottom outer frame 42, T-shaped connectors 43 for connecting the elongate members 30 to the cross-member(s) 69, and cross-shaped connectors 45 also for connecting the elongate members 30 to the cross-member(s) 69. In FIG. 9, it appears that each corner connector 41 connects two segments of the bottom outer frame 42 that are at right angles to each other within the plane of the drawing. However, these corner connectors 41 may also connect to the elongate legs 80 described below, which if shown in FIG. 9 would extend into the plane of the drawing. Each T-shaped connector 43 may have a through-hole through which an elongate member 50 may pass, and a second hole (orthogonal to the through-hole) into which a cross-member 69 may be inserted. Alternatively, instead of a single elongate member 50 passing through a through-hole in the T-shaped connector 43, two elongate member segments 55, 57 may be inserted into the through-hole. Or, if instead of a through-hole the T-shaped connector 43 has two colinear blind holes, the two elongate member segments 55, 57 may be inserted into the two blind holes. Likewise, a cross-shaped connector 45 may have two orthogonal through-holes, or one through-hole plus two blind holes, or four blind holes, into which the elongate member(s) 50 and cross-member(s) 69 may be inserted.

The device 10 also includes a plurality of elongate legs 80 each having a respective top end 82 and a respective bottom end 84, wherein each bottom end 84 is integral with the container 16. For example, the lower portions of the elongate legs 80 (which include the bottom ends 84) may form the corner edges of the container 16. As illustrated in FIGS. 1-8, at the very end or tip of the top end 82 of each elongate leg 80 is a top end tip 88. (As used herein, the top end 82 of an elongate leg 80 may include the respective top end tip 88.) The bottom face 40, top face 20 and support frame 90 may have respective centers 48, 28, 98 defining a central vertical axis 100 running through the device 10, and the elongate legs 80 may be curved inward toward this central vertical axis 100. In other words, each elongate leg 80 may have a middle portion 86 between the respective top and bottom ends 82, 84, and the elongate legs 80 may be curved such that the middle portions 86 are disposed closer to the central vertical axis 100 than are the top and bottom ends 82, 84. Each elongate leg 80 may be formed from a single piece of rod or tubing, or from two separate pieces connected together (such as by a corner connector 41 as described above).

The device 10 further includes a support frame 90 formed by the top ends 82 or tips 88 of the elongate legs 80 and at least one transverse member 92. Each transverse member 92 may be connected to at least two of the elongate legs 80 near the respective top ends 82 of the legs 80. The transverse member(s) 92 may be connected to the very ends of the legs 80 at the top end tips 88, or they may be connected to the top ends 82 at points that are spaced some distance away from the top end tips 88. For example, FIGS. 1-8 schematically illustrate five different configurations of the support frame 90. In the first configuration (FIGS. 1-3) and the fifth configuration (FIGS. 7-8), four transverse members 92 are connected to the tips 88 of the legs 80, forming a support frame 90 having a generally rectangular "footprint" (i.e., the impression or contact that the support frame 90 would make with a court surface 9 when the device 10 is oriented in the second position 12). In the second and third configurations (FIGS. 4 and 5, respectively), two opposed transverse members 92 are connected to the tips 88 of the legs 80, and two other opposed transverse members 92 are connected to the top ends 82 of the legs 80 spaced some distance away from the tips 88. In each of these two configurations, the support frame 90 has a footprint that is formed by the pair of opposed transverse members 92 that are connected to the tips 88 of the legs 80; however, the other pair of opposed transverse members 92 provide support to the device 10 and form part of the support frame 90. And in the fourth configuration (FIG. 6), all four transverse members 92 are connected to points at the top ends 82 of the legs 80 that are spaced some distance away from the top end tips 88. In this configuration, the support frame 90 has a footprint formed only by the four top end tips 88. Various other configurations of the support frame 90 are possible beyond those illustrated in the drawings, including the use of only a single transverse member 92 which connects to two or more legs 80, transverse members 92 which are connected diagonally between opposite corner legs 80, etc.

Figure 7:
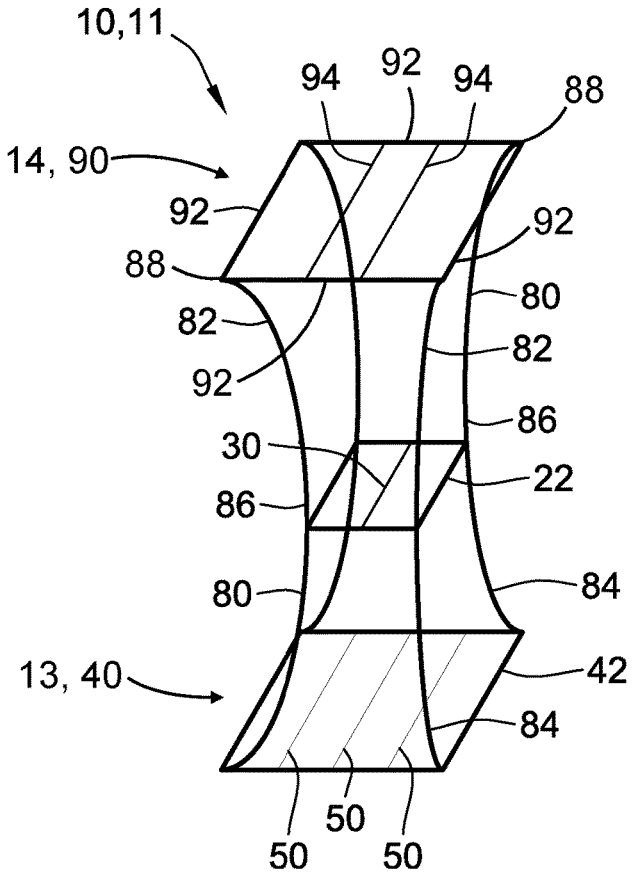
FIGS. 7-8 are schematic perspective and side views, respectively, of a fifth configuration of a device disposed in a first position (with the side walls removed) in accordance with the disclosure.

The outer perimeter 96 of the support frame 90 may be about the same size as the outer perimeter 56 of the bottom outer frame 42. The support frame 90 may serve as a handle for grasping and maneuvering the device 10 in the first position 11. For example, one or two transverse members 92 may be grasped by hand and used as handle(s) for maneuvering the device 10. As illustrated in FIG. 7, in addition to the transverse members 92, the support frame 90 may include one or more handle members 94 which may be attached to two opposed transverse members 92 or otherwise connected to provide a handle for grasping and maneuvering the device 10. In the first position 11, the device 10 may be supported on the court surface 9 by the bottom face 40, and in the second position 12, the device 10 may be supported on the court surface 9 by the support frame 90.

Each of the top face 20 and the bottom face 40 may be generally rectangular, and the at least one side wall 70 may comprise a side wall assembly 79 of four side walls 70. For example, the side wall assembly 79 may comprise four contiguous side walls 70 as shown schematically in FIG. 13, or four separate walls as shown schematically in FIG. 14. The device 10 may be constructed by assembling the container 16, elongate legs 80 and support frame 90 to provide an overall frame (such as represented schematically in FIGS. 1-8), and then the walls 70 making up the side wall assembly 79 may be attached to the overall frame. The side walls/assembly 70, 79 may be made of plastic sheet (e.g., molded or cut to size), fabric (e.g., canvas), mesh/netting material, rods/tubes (such as may be used to form the bottom face 40, top face 20, elongate legs 80 and/or support frame 90), or using other suitable structures and material. In the arrangement of contiguous side walls 70 schematically illustrated in FIG. 13, the side walls/assembly 70, 79 may be wrapped around the overall frame and attached thereto (such as by adhesive, zip ties, etc.). And in the arrangement of separate walls 70 schematically illustrated in FIG. 14, each wall 70 may have grommets or eyelets 81 about the periphery of each wall 70, and each wall 70 may be attached to the overall frame (and optionally to the grommets or eyelets 81 on the peripheries of the adjacent walls 70) by using string, elastic cord, zip ties, etc. 83, which may be optionally zig-zagged as illustrated by FIG. 14.

Figure 13:
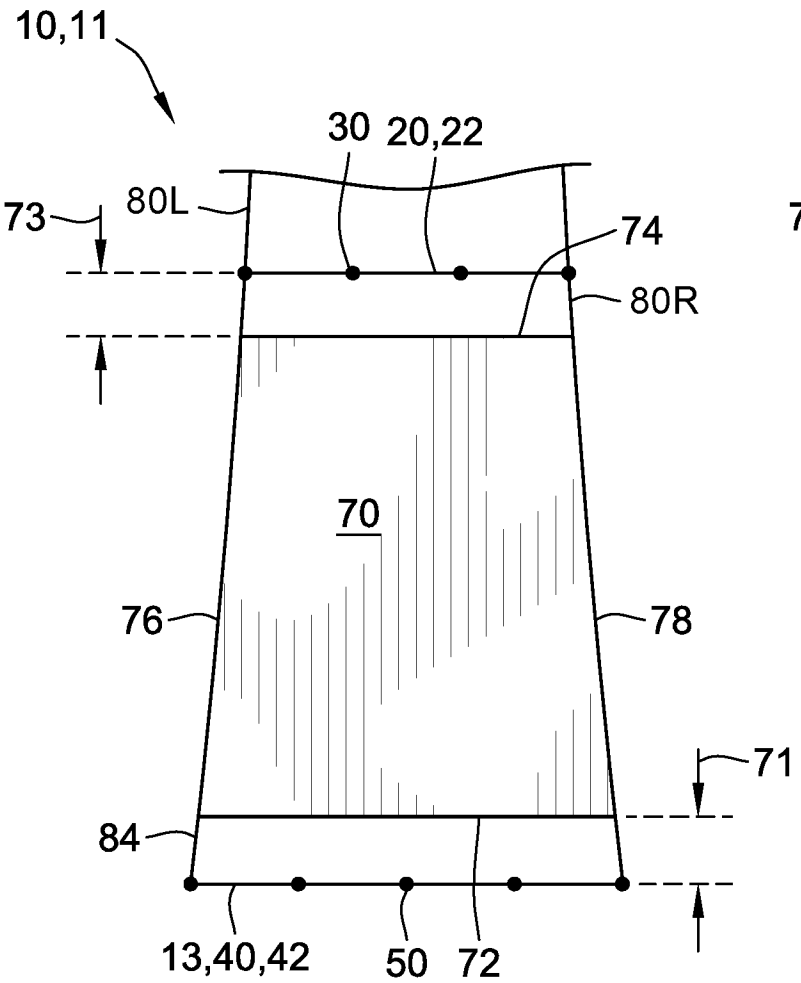

As viewed in FIGS. 13-14, each side wall 70 may have a bottom edge 72 adjacent the bottom face 40, a top edge 74 adjacent the top face 20, a left edge 76 adjacent the left elongate leg 80L, and a right edge 78 adjacent the right elongate leg 80R. (Note that "left" and "right" are used here merely for the sake of reference and convenience.) An offset or spacing 71 may be provided between the bottom edge 72 and the bottom face 40, another offset or spacing 73 between the top edge 74 and the top face 20, another offset or spacing 75 between the left edge 76 and the left elongate leg 80L, and another offset or spacing 77 between the right edge 78 and the right elongate leg 80R. Each of these offsets or spacings 71, 73, 75, 77 may be less than the diameter 3 of the type of ball 1 intended to be used with the device 10, so that balls 1 do not fall out of the container 16 through the offsets or spacings 71, 73, 75, 77.

Figure 10:
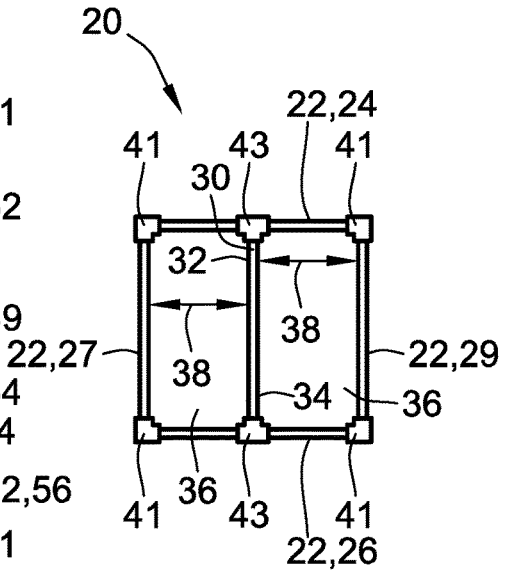
FIG. 10 is a top plan view of a top face of a device in accordance with the disclosure.

FIG. 10 shows a detailed plan view of one embodiment of the top face 20, which may include a top outer frame 22 and at least one elongate component 30. (Note that FIGS. 7, 8 and 10 show one elongate component 30, while FIGS. 1-6 show three elongate components 30. Where two or more elongate components 30 are used, they may be disposed generally parallel with one another.) Each elongate component 30 may have a third end 32 connected to a third side 24 of the top outer frame 22, and a fourth end 34 connected to a fourth side 26 of the top outer frame 22. The elongate component(s) 30 may be arranged so as to provide a gap 36 between each pair of adjacent elongate components 30, and optionally also between the top outer frame 22 (e.g., side 27 and side 29) and each elongate component 30 adjacent thereto, with each gap 36 having a second width 38 approximately equal to the first width 58. The width 38 of these gaps 36 is selected such that balls 1 within the container 16 may not easily fall through the gaps 36 (i.e., they will be retained within the interior 18 of the container 16), yet a ball 1 may be pushed by hand through a gap 36 so that the manually compressed ball 5 may enter into and be retained by the container 16. Thus, when the device 10 is in the first position 11, one may manually add balls 1, 5 into the container 16 through the top face 20 without having to invert the device 10 into the second position 12. As with the bottom face 40, the top face 20 may include corner connectors 41 for connecting together the segments making up the top outer frame 22, as well as T-shaped connectors 43 for connecting the elongate components 30 to the top outer frame 22. Although not shown in the drawings, the top face 20 may include a door similar to the door 60 in the bottom face 40.

With the device 10 in the first "pickup" or "maneuvering" position 11, one or more balls 1, 5 may be received into an interior 18 of the container 16 in two different ways. One way (illustrated schematically in FIG. 15) is by pressing the bottom face 40 "downward" (i.e., in the direction 15 indicated) against one or more ball(s) 1, 5 sitting atop the court surface 9, so as to urge the ball(s) 1, 5 through the opening(s) 54 and into the container 16. And the other way is by manually forcing the ball(s) 1, 5 through one of the gaps 36 and into the container 16. The openings 54 and gaps 36 are dimensioned to be less than the diameter 3 of the balls 1 so that the balls 1 do not easily fall out of the container 16, but can easily be passed into the container 16 as described.

The bottom face 40, top face 20, support frame 90 and elongate legs 80 may be made of rods having the same diameter and made of the same material. This allows much of the device 10 to be constructed using only one selection of tube stock, rod stock or the like (along with suitable connectors 41, 43, 45). While FIGS. 9-12 show the device 10 utilizing corner connectors 41, T-shaped connectors 43 and cross-shaped connectors 45 as part of the bottom face 40, top face 20 and support frame 90, the device 10 may also be formed without such connectors 41, 43, 45. For example, other types of connectors may be used. Also, some or all of the respective parts making up the bottom face 40, top face 20, support frame 90 and/or the elongate legs 80 may be fabricated or molded without the need of connectors, or using other types of connectors.

The device 10 may further include at least one roller 102 on each of the bottom outer frame 42 and the support frame 90 (e.g., on one or more transverse members 92). For example, if the bottom outer frame 42 and the support frame 90/transverse members 92 are constructed out of round rods, these rods may pass through the inner race(s) of one or more bearinged rollers 102, such that the roller(s) 102 spin about the rods on which they are rotatably mounted. Optionally, one or more rollers 102 may be placed on each side of the bottom outer frame 42 and the support frame 90, thus allowing the device to be easily rolled in any direction and in either of the first and second positions 11, 12.

In another embodiment, the ball pickup device 10 may be viewed as including a bottom frame 40, a top frame 20 and a side wall assembly 79 defining a container 16. The bottom frame 40 may have a generally rectangular bottom frame outer portion 42 and a plurality of elongate members 50. The bottom frame outer portion 42 defines a bottom frame outer perimeter 56 and includes a pair of opposed first side portions 47, 49 and a pair of opposed second side portions 44, 46. The elongate members 50 are oriented in a direction 52 parallel to the first side portions 47, 49 and cooperate to form a door 60 having a first end 62 rotatably connected to a first side 44 of the bottom frame outer portion 42 and a second end 64 engageably and disengageably connectable to a second side 46 of the bottom frame outer portion 42. The elongate members 50 may be spaced apart so as to provide an opening 54 between each pair of adjacent elongate members 50, as well as between the bottom frame outer portion 42 and each elongate member 50 adjacent thereto, with each opening 54 having a first width 58 less than a diameter 3 of the ball 1 and through which the ball 1 may be forced (e.g., when it is compressed 5).

The top frame 20 is disposed or oriented generally parallel with the bottom frame 40 and has a top frame outer portion 22 defining a top frame outer perimeter 25 that is smaller than the bottom frame outer perimeter 56. The top frame 20 includes at least one elongate component 30, each having a respective third end 32 connected to a third side 24 of the top frame outer portion 22 and a respective fourth end 34 connected to a fourth side 26 of the top frame outer portion 22. The one or more elongate components 30 are arranged so as to provide a gap 36 between each pair of adjacent elongate components 30, and optionally between the top frame outer portion 22 and each elongate component 30 adjacent thereto, with each gap 36 having a second width 38 that is approximately equal to the first width 58.

The device 10 includes a plurality of elongate legs 80, each having a respective top end 82, a respective bottom end 84 and a respective middle point 86 between the respective top and bottom ends 82, 84. Each elongate leg bottom end 84 is attached to the bottom frame 40, and each elongate leg middle point 86 is attached to the top frame 20. The side wall assembly 79 may comprise four side walls 70, with each side wall 70 being disposed generally between and attached to a respective pair of adjacent elongate legs 80, and extending between the bottom frame 40 and the top frame 20, wherein the bottom frame 40, top frame 20 and side wall assembly 79 define a container 16 therewithin. The device further includes a support frame 90 formed by the elongate leg top ends 82 and at least one transverse member 92. Each transverse member 92 may be connected to at least two of the elongate legs 80 proximate their respective top ends 82.

The bottom frame 40, top frame 20 and support frame 90 may have respective centers 48, 28, 98 defining a central vertical axis 100 through those centers 48, 28, 98. Each of the elongate legs 80 may be curved in a generally arcuate shape, such that the respective middle point 86 of each elongate leg 80 is closer to the central vertical axis 100 than is each of the respective top and bottom ends 82, 84 of each elongate leg 80. In both embodiments disclosed herein, the curved or arcuate shape of the elongate legs 80 may provide structural strength and rigidity to the overall device 10 (e.g., making it sturdy). The curved or arcuate shape may also enable a user to use the device 10 in corners of courts 7 (e.g., near chain-link fences or walls) in a way that is easier and more effective than without the curved or arcuate legs 80. Additionally, the curved or arcuate shape is aesthetically pleasing and unique-looking.

As with the previous embodiment mentioned above, the present embodiment is configured to be disposed in a first "pickup" or "maneuvering" position 11 with the device 10 supported on the court surface 9 by the bottom frame 40, and in a second "teaching" or "serving" position 12 with the device 10 supported on the court surface 9 by the support frame 90, with the device 10 configured to be inverted between the first and second positions 11, 12 without movement of any parts of the device 10 with respect to each other (i.e., without any moving parts).

The above description is intended to be illustrative, and not restrictive. While various specific embodiments have been presented, those skilled in the art will recognize that the disclosure can be practiced with various modifications within the spirit and scope of the claims. For example, the above-described embodiments (and/or aspects thereof) may be used in combination with each other. In addition, many modifications may be made to adapt a particular situation or material to the teachings of the disclosure without departing from its scope. While the dimensions and types of materials described herein are intended to be illustrative, they are by no means limiting and are exemplary embodiments. Moreover, in the following claims, use of the terms "first", "second", "top", "bottom", "vertical", etc. are used merely as labels, and are not intended to impose numerical or positional requirements on their objects. As used herein, an element or step recited in the singular and preceded by the word "a" or "an" should be understood as not excluding plural of such elements or steps, unless such exclusion is explicitly stated. Additionally, the phrase "at least one of A and B" should be understood to mean "only A, only B, or both A and B." Furthermore, unless explicitly stated to the contrary, embodiments "comprising" or "having" an element or a plurality of elements having a particular property may include additional such elements not having that property. And when broadly descriptive adverbs such as "generally" are used herein to modify an adjective, such as in the phrase "generally rectangular" or "generally parallel", these adverbs mean "for the most part", "to a significant extent" and/or "to a large degree", and do not necessarily mean "perfectly", "completely", "strictly" or "entirely". Additionally, the word "proximate" may be used herein to describe the location of an object or portion thereof with respect to another object or portion thereof, and/or to describe the positional relationship of two objects or their respective portions thereof with respect to each other, and may mean "near", "adjacent", "close to", "close by", "at" or the like.

This written description uses examples, including the best mode, to enable those skilled in the art to make and use devices, systems and compositions of matter, and to perform methods, according to this disclosure. It is the following claims, including equivalents, which define the scope of the present disclosure.

What is claimed is:

1. A device for picking up a ball from a court surface, comprising:

a bottom frame having a generally rectangular bottom frame outer portion and a plurality of elongate members, the bottom frame outer portion defining a bottom frame outer perimeter and including a pair of opposed first side portions and a pair of opposed second side portions, the elongate members being oriented in a direction parallel to the first side portions and cooperating to form a door having a first end rotatably connected to one of the second side portions and a second end engageably and disengageably connectable to another of the second side portions, the elongate members being spaced apart so as to provide an opening between each pair of adjacent elongate members and between the bottom frame outer portion and each elongate member adjacent thereto, each opening having a first width less than a diameter of the ball and through which the ball may be forced;

a top frame disposed generally parallel with the bottom frame and having a top frame outer portion defining a top frame outer perimeter smaller than the bottom frame outer perimeter, the top frame having at least one elongate component, each of the at least one elongate component having a respective third end connected to a third side of the top frame outer portion and a respective fourth end connected to a fourth side of the top frame outer portion, the at least one elongate component being arranged so as to provide a gap between the top frame outer portion and each elongate component adjacent thereto and between any pair of adjacent elongate components, each gap having a second width approximately equal to the first width;

a plurality of elongate legs, each having a respective top end, a respective bottom end and a respective middle point between the respective top and bottom ends, wherein each bottom end is attached to the bottom frame and each middle point is attached to the top frame;

a side wall assembly comprising four side walls, each side wall generally disposed between and attached to a respective pair of adjacent elongate legs and extending between the bottom frame and the top frame, wherein the bottom frame, top frame and side wall assembly define a container therewithin; and a support frame formed by the top ends and at least one transverse member, each of the at least one transverse member being connected to at least two of the elongate legs proximate their respective top ends;

wherein the device is configured to be disposed in first and second positions with the device supported on the court surface by the bottom frame and the support frame, respectively, and wherein the device is configured to be inverted between the first and second positions without movement of any parts of the device with respect to each other, and wherein the bottom frame, top frame and support frame have respective centers defining a central vertical axis, and wherein each of the plurality of elongate legs is curved in a generally arcuate shape such that the respective middle point of each elongate leg is closer to the central vertical axis than is each of the respective top and bottom ends of each elongate leg.

2. A device according to claim 1, wherein, in the first position, the ball may be received into an interior of the container by either of:

pressing the bottom frame against the ball sitting atop the court surface so as to urge the ball through one of the openings, and manually forcing the ball through one of the gaps.

3. A device according to claim 1, wherein the support frame may serve as a handle for grasping the device in the first position.

4. A device according to claim 1, wherein the door includes at least one cross-member connecting the elongate members together at at least one of the first end and the second end, and at least one latch disposed at the second end, wherein each of the at least one latch is configured to engageably and disengageably connect to the second side of the bottom frame outer portion.

5. A device according to claim 1, wherein the top frame is generally rectangular.

6. A device according to claim 1, further comprising at least one roller on each of the bottom frame outer portion and the support frame.

7. A device according to claim 1, wherein an outer perimeter of the support frame is the same size as the bottom frame outer perimeter.

8. A device according to claim 1, wherein the bottom frame, top frame, support frame and elongate legs are made of rods having the same diameter and made of the same material.

9. A device according to claim 1, wherein the side wall assembly comprises four contiguous side walls.

10. A device for picking up a ball from a court surface, comprising:

a bottom frame having a generally rectangular bottom frame outer portion and a plurality of elongate members, the bottom frame outer portion defining a bottom frame outer perimeter and including a pair of opposed first side portions and a pair of opposed second side portions, the elongate members being oriented in a direction parallel to the first side portions and cooperating to form a door having a first end rotatably connected to one of the second side portions and a second end engageably and disengageably connectable to another of the second side portions, the elongate members being spaced apart so as to provide an opening between each pair of adjacent elongate members and between the bottom frame outer portion and each elongate member adjacent thereto, each opening having a first width less than a diameter of the ball and through which the ball may be forced;

a top frame disposed generally parallel with the bottom frame and having a top frame outer portion defining a top frame outer perimeter smaller than the bottom frame outer perimeter, the top frame having at least one elongate component, each of the at least one elongate component having a respective third end connected to a third side of the top frame outer portion and a respective fourth end connected to a fourth side of the top frame outer portion, the at least one elongate component being arranged so as to provide a gap between the top frame outer portion and each elongate component adjacent thereto and between any pair of adjacent elongate components, each gap having a second width approximately equal to the first width;

a plurality of elongate legs, each having a respective top end, a respective bottom end and a respective middle point between the respective top and bottom ends, wherein each bottom end is attached to the bottom frame and each middle point is attached to the top frame;

a side wall assembly comprising four contiguous side walls, each side wall generally disposed between and attached to a respective pair of adjacent elongate legs and extending between the bottom frame and the top frame, wherein the bottom frame, top frame and side wall assembly define a container therewithin; and a support frame formed by the top ends and at least one transverse member, each of the at least one transverse member being connected to at least two of the elongate legs proximate their respective top ends;

wherein the device is configured to be disposed in first and second positions with the device supported on the court surface by the bottom frame and the support frame, respectively, and wherein the device is configured to be inverted between the first and second positions without movement of any parts of the device with respect to each other, wherein, in the first position, the ball may be received into an interior of the container by either of pressing the bottom frame against the ball sitting atop the court surface so as to urge the ball through one of the openings and manually forcing the ball through one of the gaps, and wherein the bottom frame, top frame and support frame have respective centers defining a central vertical axis, and wherein each of the plurality of elongate legs is curved in a generally arcuate shape such that the respective middle point of each elongate leg is closer to the central vertical axis than is each of the respective top and bottom ends of each elongate leg.

11. A device according to claim 10, wherein the support frame may serve as a handle for grasping the device in the first position.

12. A device according to claim 10, wherein the door includes at least one cross-member connecting the elongate members together at at least one of the first end and the second end, and at least one latch disposed at the second end, wherein each of the at least one latch is configured to engageably and disengageably connect to the second side of the bottom frame outer portion.

13. A device according to claim 10, wherein the top frame is generally rectangular.

14. A device according to claim 10, wherein an outer perimeter of the support frame is the same size as the bottom frame outer perimeter.

15. A device for picking up a ball from a court surface, comprising:

a bottom frame having a generally rectangular bottom frame outer portion and a plurality of elongate members, the bottom frame outer portion defining a bottom frame outer perimeter and including a pair of opposed first side portions and a pair of opposed second side portions, the elongate members being oriented in a direction parallel to the first side portions and cooperating to form a door having a first end rotatably connected to one of the second side portions and a second end engageably and disengageably connectable to another of the second side portions, the elongate members being spaced apart so as to provide an opening between each pair of adjacent elongate members and between the bottom frame outer portion and each elongate member adjacent thereto, each opening having a first width less than a diameter of the ball and through which the ball may be forced, wherein the door includes at least one cross-member connecting the elongate members together at at least one of the first end and the second end, and at least one latch disposed at the second end, wherein each of the at least one latch is configured to engageably and disengageably connect to the second side of the bottom frame outer portion;

a top frame disposed generally parallel with the bottom frame and having a top frame outer portion defining a top frame outer perimeter smaller than the bottom frame outer perimeter, the top frame having at least one elongate component, each of the at least one elongate component having a respective third end connected to a third side of the top frame outer portion and a respective fourth end connected to a fourth side of the top frame outer portion, the at least one elongate component being arranged so as to provide a gap between the top frame outer portion and each elongate component adjacent thereto and between any pair of adjacent elongate components, each gap having a second width approximately equal to the first width;

a plurality of elongate legs, each having a respective top end, a respective bottom end and a respective middle point between the respective top and bottom ends, wherein each bottom end is attached to the bottom frame and each middle point is attached to the top frame;

a side wall assembly comprising four side walls, each side wall generally disposed between and attached to a respective pair of adjacent elongate legs and extending between the bottom frame and the top frame, wherein the bottom frame, top frame and side wall assembly define a container therewithin; and a support frame formed by the top ends and at least one transverse member, each of the at least one transverse member being connected to at least two of the elongate legs proximate their respective top ends;

wherein the device is configured to be disposed in first and second positions with the device supported on the court surface by the bottom frame and the support frame, respectively, and wherein the device is configured to be inverted between the first and second positions without movement of any parts of the device with respect to each other, and wherein the bottom frame, top frame and support frame have respective centers defining a central vertical axis, and wherein each of the plurality of elongate legs is curved in a generally arcuate shape such that the respective middle point of each elongate leg is closer to the central vertical axis than is each of the respective top and bottom ends of each elongate leg.

16. A device according to claim 15, wherein, in the first position, the ball may be received into an interior of the container by either of:

pressing the bottom frame against the ball sitting atop the court surface so as to urge the ball through one of the openings, and manually forcing the ball through one of the gaps.

17. A device according to claim 15, wherein the top frame is generally rectangular.

18. A device according to claim 15, wherein an outer perimeter of the support frame is the same size as the bottom frame outer perimeter.

19. A device according to claim 15, wherein the side wall assembly comprises four contiguous side walls.

* * * * *